US007199776B2

(12) United States Patent
Ikeda et al.

(10) Patent No.: US 7,199,776 B2
(45) Date of Patent: Apr. 3, 2007

(54) IMAGE DISPLAY METHOD AND APPARATUS

(75) Inventors: Jun Ikeda, Fukuoka (JP); Shuichi Ojima, Fukuoka (JP); Tsuyoshi Hirashima, Kasuya-gun (JP); Ryouta Hata, Iizuka (JP); Shinya Kiuchi, Iizuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 339 days.

(21) Appl. No.: 10/447,238

(22) Filed: May 29, 2003

(65) Prior Publication Data

US 2003/0222884 A1 Dec. 4, 2003

(30) Foreign Application Priority Data

May 29, 2002 (JP) ..... 2002-155736

(51) Int. Cl.
*G09G 3/18* (2006.01)

(52) U.S. Cl. ..... 345/89; 345/690; 345/204; 345/102

(58) Field of Classification Search ..... 345/102, 345/204, 88–89, 690, 77, 207; 349/61–65, 349/67–68; 382/167; 348/254
See application file for complete search history.

(56) References Cited

U.S. PATENT DOCUMENTS 5,359,342 A * 10/1994 Nakai et al. ..... 345/89
6,111,559 A * 8/2000 Motomura et al. ..... 345/102
6,300,931 B1 * 10/2001 Someya et al. ..... 345/102
6,429,839 B1 * 8/2002 Sakamoto ..... 345/87
6,504,523 B1 * 1/2003 Sugawara et al. ..... 345/98
6,597,339 B1 * 7/2003 Ogawa ..... 345/102
6,795,053 B1 * 9/2004 Funamoto et al. ..... 345/102
6,839,048 B2 * 1/2005 Park ..... 345/102
6,873,311 B2 * 3/2005 Yoshihara et al. ..... 345/87
6,937,224 B1 * 8/2005 Miyachi ..... 345/102
2001/0026283 A1 * 10/2001 Yoshida et al. ..... 345/600

FOREIGN PATENT DOCUMENTS

EP 1111578 * 6/2001
JP 1-239589 9/1989

* cited by examiner

*Primary Examiner*—Lun-Yi Lao
(74) *Attorney, Agent, or Firm*—Wenderoth, Lind & Ponack, L.L.P.

(57) ABSTRACT

There is provided a correlation between adjustment of luminance of a LCD and adjustment of luminance of a backlight. Luminance average value "Iave" is determined from display data. Luminance maximum value "I1max" in a macro area is determined from the display data. Luminance is adjusted with reference to luminance-transformed luminance. In luminance transformation, slope average "r1" in a range of 0≦I<Iave, slope average "r2" in a range of Iave≦I<I1max, and slope average "r3" in a range of I≧I1max establish a relationship of r1≧r2>r3 in an area defined by a horizontal axis showing luminance "I" and a vertical axis showing luminance-transformed luminance "I#".

37 Claims, 7 Drawing Sheets

Fig. 9

| luminance characteristic amount Ip | normalizing parameter [Ip] | light emitting luminance [Ip#] |
|---|---|---|
| 0 | 0 | 0 |
| ⋮ | ⋮ | ⋮ |
| 12 | 16 | 1 |
| ⋮ | ⋮ | ⋮ |
| 20 | 23 | 2 |
| ⋮ | ⋮ | ⋮ |
| 100 | 100 | 39 |
| ⋮ | ⋮ | ⋮ |
| 140 | 140 | 77 |
| ⋮ | ⋮ | ⋮ |
| 230 | 230 | 207 |
| ⋮ | ⋮ | ⋮ |
| 255 | 255 | 255 |

IMAGE DISPLAY METHOD AND APPARATUS

BACKGROUND OF THE INVENTION

1. Field of the Invention

The present invention relates to an image display method and apparatus. More particularly, the present invention relates to an art of dynamically adjusting a contrast and light source luminance in accordance with entered display data in an image display apparatus that is operable to irradiate light from a light source such as a backlight onto a light-receiving display device as represented by a liquid crystal panel, in order to provide a high level of perceptible screen luminance.

2. Description of the Related Art

A prior art concerning the above is disclosed in published Japanese Patent Application Laid-Open No. 1-239589. The prior art provides a unit operable to detect a maximum value of an image signal to permit light such as a light source to be irradiated in proportional to the detected maximum value, thereby reducing electric power consumption.

The term "micro area" as set forth herein refers to a small region of a display screen where the maximum luminance is available. The micro area includes a single pixel or otherwise several pixels. The term "macro area" as given herein refers to a large region of the display screen where bright highlights are available.

However, the prior art has some problems as discussed below.

Problem 1: When a micro area having great luminance is present in the display screen, then it is difficult to obtain beneficial effects of reducing power consumption.

When a micro area having great luminance, such as dotted areas and white characters, is present in the display screen, then the prior art provides control over the light source with reference to such a micro area. As a result, the light source tends to be excessively controlled toward bright illumination. This drawback precludes a reduction in power consumption.

Problem 2: A pure color is insufficient in visual quality.

When color display is made according to the prior art, then a Y-value in YUV signals or an average of RGB values in RGB signals is used as "luminance". Adjustment is made in accordance with the "luminance".

Assume that display data having high-saturation (e.g., in a RGB ratio of 0%, 0%, and 80%) in the entire screen is entered. The display data corresponds to nearly solid "blue". At this time, the YUV signals have a Y-value of 9%, while the RGB signals have a RGB average of 27%.

As a result, according to the prior art, a light source has luminance as small as 9% or 27%, and true "blue" cannot be displayed, even when a signal of "blue" on a display panel has a value as high as, e.g., 100%.

As seen from the above, a problem with the prior art is that a pure color tends to be insufficient in visual quality.

Problem 3: Characteristics inherent to a display device are not reflected.

The prior art takes no account of characteristics inherent to a display device. As a result, it is difficult to obtain desired luminance under severe circumstances in which luminance tends to be insufficient because of a reduction in electric power.

OBJECTS AND SUMMARY OF THE INVENTION

In view of the above, a first object of the present invention is to provide an improved art of making a further reduction in electric power.

A second object of the present invention is to provide an improved art that provides high-visual quality of a pure color while allowing a light source to consume less power.

A third object of the present invention is to provide an improved art that provides accurate adjustment of a display device and accurate adjustment of the light source while allowing the light source to consume less power.

A first aspect of the present invention provides an image display method comprising:

irradiating light from a light source to a light-receiving display device to display an image;

providing a correlation between adjustment of luminance of the display device and adjustment of luminance of the light source in accordance with entered display data;

determining a characteristic-determining amount from the display data;

providing luminance transformation of luminance taken out of the display data, thereby providing the luminance-transformed luminance; and adjusting the luminance of the display device in accordance with the luminance-transformed luminance, wherein the luminance transformation has transformation characteristics in which different slope averages in the vicinity of the characteristic-determining amount are exhibited in an area defined by a horizontal axis showing luminance "I" taken out of the display data and a vertical axis showing luminance-transformed luminance "I#".

This construction determines the characteristic-determining amount from the display data, and sets the transformation characteristics of the luminance transformation in accordance with the determined characteristic-determining amount. This feature allows the display device to be controlled in accordance with the display data.

The transformation characteristics have different slope averages in the vicinity of the characteristic-determining amount. This feature allows for display control for each luminance area.

A second aspect of the present invention provides an image display method as defined in the first aspect of the present invention, wherein in the transformation characteristics, a region having luminance smaller than the characteristic-determining amount is set to have an average slope greater than an average slope of a region having luminance greater than the characteristic-determining amount.

In the above construction, the region having luminance smaller than the characteristic-determining amount and closer in distance to a coordinate origin is important to maintain a perceptible contrast. In the transformation characteristics, the region having luminance smaller than the characteristic-determining amount is set to have an average slope greater than an average slope of a region having luminance greater than the characteristic-determining amount. This feature retains good visual quality.

A region having luminance greater than the characteristic-determining amount and closer in distance to a full scale is bright. Such a bright region is set to have an average slope smaller than the average slope of the region having luminance smaller than the characteristic-determining amount. This feature saves power consumption.

A third aspect of the present invention provides an image display method as defined in the first aspect of the present invention, wherein in the transformation characteristics, a region closer in distance to a coordinate origin is set to have an average slope greater than an average slope of another region.

In the above construction, the most important region to maintain a perceptible contrast is the region closer in distance to the coordinate origin. In the transformation characteristics, the region closer to the coordinate origin is set to have an average slope greater than average slopes of the other regions. This feature retains good visual quality.

A fourth aspect of the present invention provides an image display method as defined in the first aspect of the present invention, wherein in the transformation characteristics, a region closer in distance to a full scale is set to have an average slope smaller than an average slope of another region.

In the above construction, the region closer in distance to the full scale is very bright. Such a very bright region is set to have an average slope smaller than average slopes of the other regions. This feature saves power consumption.

A fifth aspect of the present invention provides an image display method as defined in the first aspect of the present invention, wherein the characteristic-determining amount includes two different characteristic-determining amounts.

This construction provides transformation characteristics in which two or greater connections and three or greater divided regions are provided.

A sixth aspect of the present invention provides an image display method as defined in the first aspect of the present invention, wherein the characteristic-determining amount includes three different characteristic-determining amounts.

This construction provides transformation characteristics in which three or greater connections and four or greater divided regions are provided.

A seventh aspect of the present invention provides an image display method as defined in the first aspect of the present invention, wherein the characteristic-determining amount includes a luminance representative value in the entire display screen.

According to this construction, the luminance representative value in the entire display screen is reflected in the transformation characteristics.

An eighth aspect of the present invention provides an image display method as defined in the seventh aspect of the present invention, wherein the luminance representative value includes one of or both a luminance average value and a maximum frequent value in a luminance histogram.

This construction allows the luminance representative value to express proper display data.

A ninth aspect of the present invention provides an image display method as defined in the first aspect of the present invention, wherein one of or both a straight line and a curved line forms the transformation characteristics.

According to this construction, the transformation characteristics formed by only the straight line provides easy processing, and completes calculation in a short time. The transformation characteristics formed by only the curved line provides smoothly varied transformation characteristics, thereby realizing fine luminance transformation. In addition, the transformation characteristics may be formed by a combination of the straight line and the curved line.

A tenth aspect of the present invention provides an image display method comprising:

irradiating light from a light source to a light-receiving display device to display an image;

providing a correlation between adjustment of luminance of the display device and adjustment of luminance of the light source in accordance with entered display data;

determining, from the display data, luminance representative value "Ir" in the entire display screen and luminance maximum value "I1max" in a macro area;

providing luminance transformation of luminance taken out of the display data, thereby providing the luminance-transformed luminance; and adjusting the luminance of the display device in accordance with the luminance-transformed luminance, wherein the luminance transformation has transformation characteristics in which slope average "r1" in a range of $0 \leqq I < Ir$, slope average "r2" in a range of $Ir \leqq I < I1max$, and slope average "r3" in a range of $I \geqq I1max$ establish a relationship of $r1 \geqq r2 > r3$ in an area defined by a horizontal axis showing luminance "I" taken out of the display data and a vertical axis showing luminance-transformed luminance "I#".

According to the above structure, the range of $0 \leqq I < Ir$ is the most important region to maintain a perceptible contrast. The region in the range of $0 \leqq I < Ir$ has slope average "r1" rendered greater than the other slope averages. This feature retains good visual quality.

The range of $Ir \leqq I < I1max$ covers a bright region. Such a bright region is difficult to perceive degradation in visual quality, even when the bright region has a contrast rendered smaller than a contrast of the region in the range of $0 \leqq I < Ir$. Accordingly, the bright region in the range of $Ir \leqq I < I1max$ has slope average "r2" rendered smaller than slope average "r1". This feature suppresses power consumption.

The range of $I \geqq I1max$ is a very bright region that has slope average "r3" rendered smaller than slope average "r2". This feature saves power consumption.

In consideration of influence on the perceptible contrast, reduced luminance is provided in the region in which degradation in visual quality is difficult to perceive. This feature considerably reduces the entire power consumption.

At the same time, the region in the range of $0 \leqq I < Ir$, which is important for perception, maintains increased luminance. This feature allows a perceptible contrast to be maintained to a high degree.

An eleventh aspect of the present invention provides an image display method as defined in the tenth aspect of the present invention, wherein slope averages "r1", "r2", and "r3" are varied according to a state that includes display content, display time, and surrounding circumstances.

This construction allows luminance to be adjusted within finer limits according to various circumstances such as display of a game screen, display of a mail-editing screen, operating time, battery drain, and surrounding illumination.

A twelfth aspect of the present invention provides an image display method as defined in the tenth aspect of the present invention, wherein saturation is adjusted in union with one or both of the adjustment of the luminance of the display device and the adjustment of the luminance of the light source.

This construction allows saturation to be adjusted together with luminance adjustment. This feature provides further improved visual quality.

A thirteenth aspect of the present invention provides an image display method as defined in the twelfth aspect of the present invention, wherein the saturation is adjusted to provide increased saturation in a region in which a perceptible contrast is reduced.

This construction allows the saturation to complement a perceptible contrast in the region in which the perceptible contrast tends to be reduced.

A fourteenth aspect of the present invention provides an image display method as defined in the tenth aspect of the present invention, wherein luminance maximum value "I2max" in a micro area is determined from the display data, and wherein luminance characteristic amount "Ip" is determined in accordance with "I1max", "I2max", "Ir", "r1", "r2", "r3", and the light source has luminance adjusted in accordance with the determined luminance characteristic amount "Ip".

This construction provides an improved correlation between the adjustment of the luminance of the light source and the adjustment of the luminance of the display device.

A fifteenth aspect of the present invention provides an image display method as defined in the tenth aspect of the present invention, wherein the luminance representative value "Ir" includes one of or both luminance average value "Iave" and a maximum frequent value in a luminance histogram.

This construction allows the luminance representative value to express proper display data.

A sixteenth aspect of the present invention provides an image display method comprising:

irradiating light from a light source to a light-receiving display device to display an image; and providing a correlation between adjustment of luminance of the display device and adjustment of luminance of the light source in accordance with entered display data, wherein a maximum value of RGB values in the entire image is employed as luminance for use in the adjustment of the luminance of the display device and the adjustment of the luminance of the light source.

This construction provides improved visual quality of a pure color. For example, for display data in a RGB ratio of 0%: 0%: 80%, luminance 80% is used in the adjustment of the luminance of the display device and the adjustment of the luminance of the light source. As a result, true "blue" can be displayed.

A seventeenth aspect of the present invention provides an image display method comprising:

irradiating light from a light source to a light-receiving display device to display an image; and providing a correlation between adjustment of luminance of the display device and adjustment of luminance of the light source in accordance with entered display data, wherein the luminance of the light source is adjusted in accordance with contra-characteristics that counteract γ-characteristics inherent to the display device.

According to this construction, the luminance adjustment of the light source counteracts γ-characteristics inherent to the display device, thereby providing accurate luminance adjustment. This feature properly provides desired luminance, and saves power consumption. As a result, visual quality can be retained under environments in which a contrast tends to be insufficient.

An eighteenth aspect of the present invention provides an image display method as defined in the seventeenth aspect of the present invention, wherein the luminance of the light source is adjusted with reference to a light-emitting compensation table.

This construction allows luminance adjustment to be made, even with contra-characteristics having non-linearity, and provides high-speed luminance adjustment with reference to the light-emitting compensation table.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 9 is an illustration showing a construction of a light-emitting compensation table.

DETAILED DESCRIPTION OF THE PREFERRED EMBODIMENT

Figure 1:
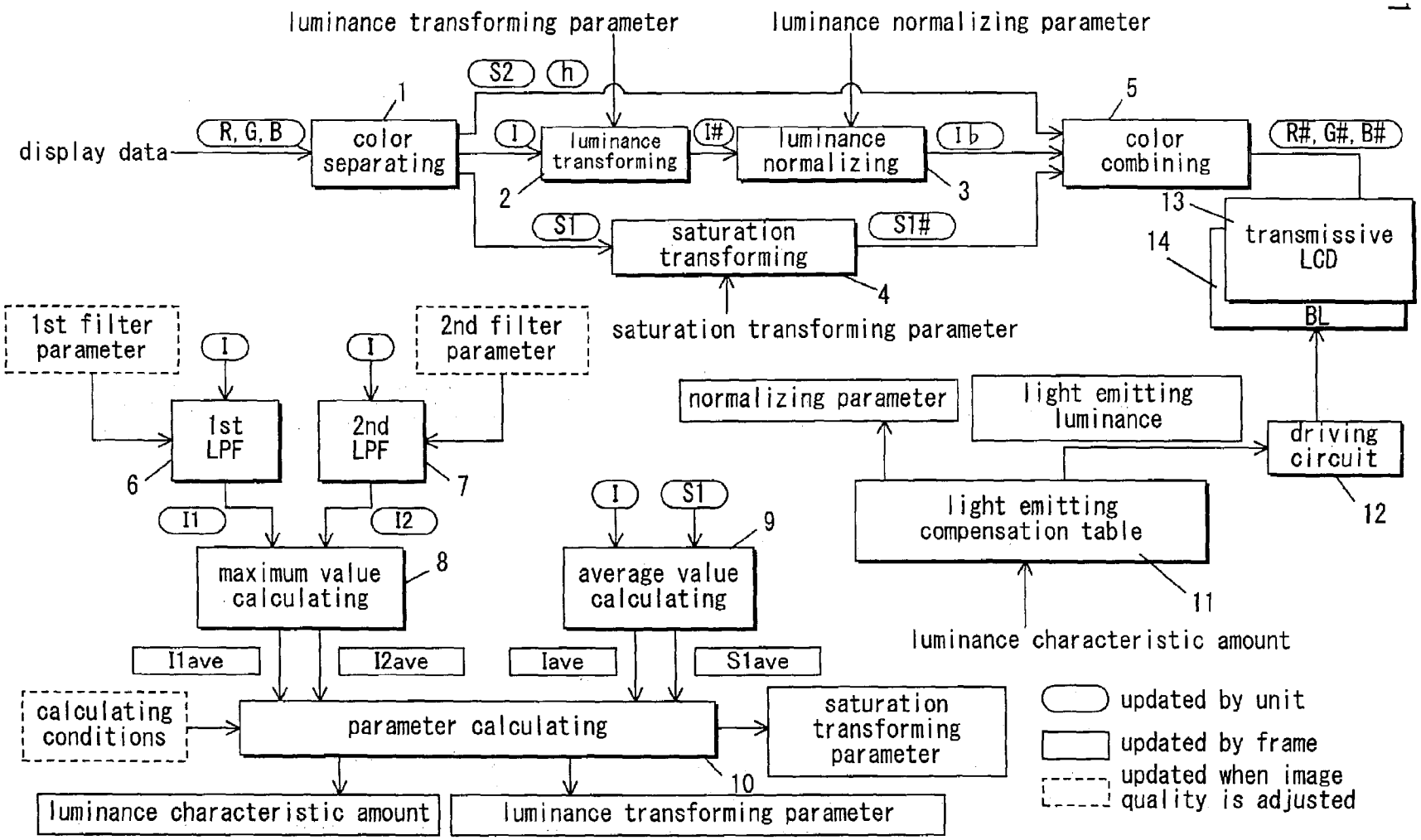
FIG. 1 is a block diagram illustrating an image display apparatus according to an embodiment of the present invention.

An embodiment of the present invention will be discussed with reference to the drawings. FIG. 1 is a block diagram illustrating an image display apparatus according to the present embodiment.

The following discusses how FIG. 1 is referenced, before discussion on components of the image display apparatus. Among values as illustrated in FIG. 1, each round-cornered enclosure contains a value (e.g., luminance "I") renewed for each pixel of display data. Each solid line, square-cornered enclosure contains a value (e.g., average luminance value "Iave") renewed for each frame. Each dotted line, square-cornered enclosure contains a value (e.g., calculation condition values) renewed according to display content, display time, and surrounding circumstances when image quality is manually or automatically adjusted.

In this example of FIG. 1, display data is entered as RGB values into the image display apparatus. RGB values (R#, G#, and B#) in which luminance has been adjusted are fed into a transmissive LCD 13 (an example of a light-receiving display device). Alternatively, the display data may be expressed using any other color space.

The present embodiment employs two different characteristic-determining amounts, luminance representative value "Ir" and luminance maximum value "I1max". The latter is confined to a macro area. The present invention may, of course, employ a greater number of different characteristic-determining amounts. For example, the present invention is also applicable when three or greater different characteristic-determining amounts are used.

The present embodiment uses luminance average value "Iave as an example of luminance representative value "Ir". Alternatively, a maximum frequent value in a luminance histogram may be used. As a further alternative, the luminance average value and the maximum frequent value may appropriately be combined together regardless of the presence of weights.

The present embodiment sets the characteristic-determining amounts as above. A characteristic-determining amount-calculating unit according to the present embodiment includes a representative-calculating unit and a maximum value-calculating unit 8. The representative-calculating unit includes an average value-calculating unit 9.

Figure 6:
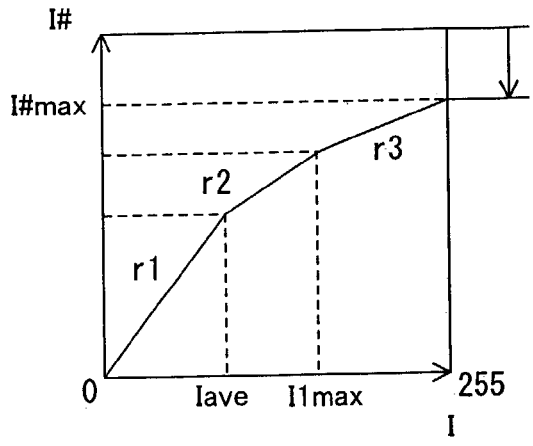
FIG. 6 is a graph illustrating luminance-transforming characteristics.

As illustrated in FIG. 6, the present embodiment discusses luminance transformation characteristics in which two connections (one connection at a position where "I" is equal to "lava", and another where "I" is equal to "I1max") and three regions (one region of $0 \leqq I < Iave$, another of $Iave \leqq I < I1max$, and the remainder of I>I1max) are exhibited. Alternatively, the present invention is also applicable when the luminance transformation characteristics exhibit three or greater connections and four or greater regions. As a further alternative, luminance transformation characteristics exhibiting a single connection and two regions are also acceptable although this alternative provides less beneficial effects.

As illustrated in FIG. 6, according to the present embodiment, a straight line forms characteristics for each of the regions. Alternatively, the straight line may be used to form characteristics for part of the regions or otherwise for all of the regions.

Figure 2:
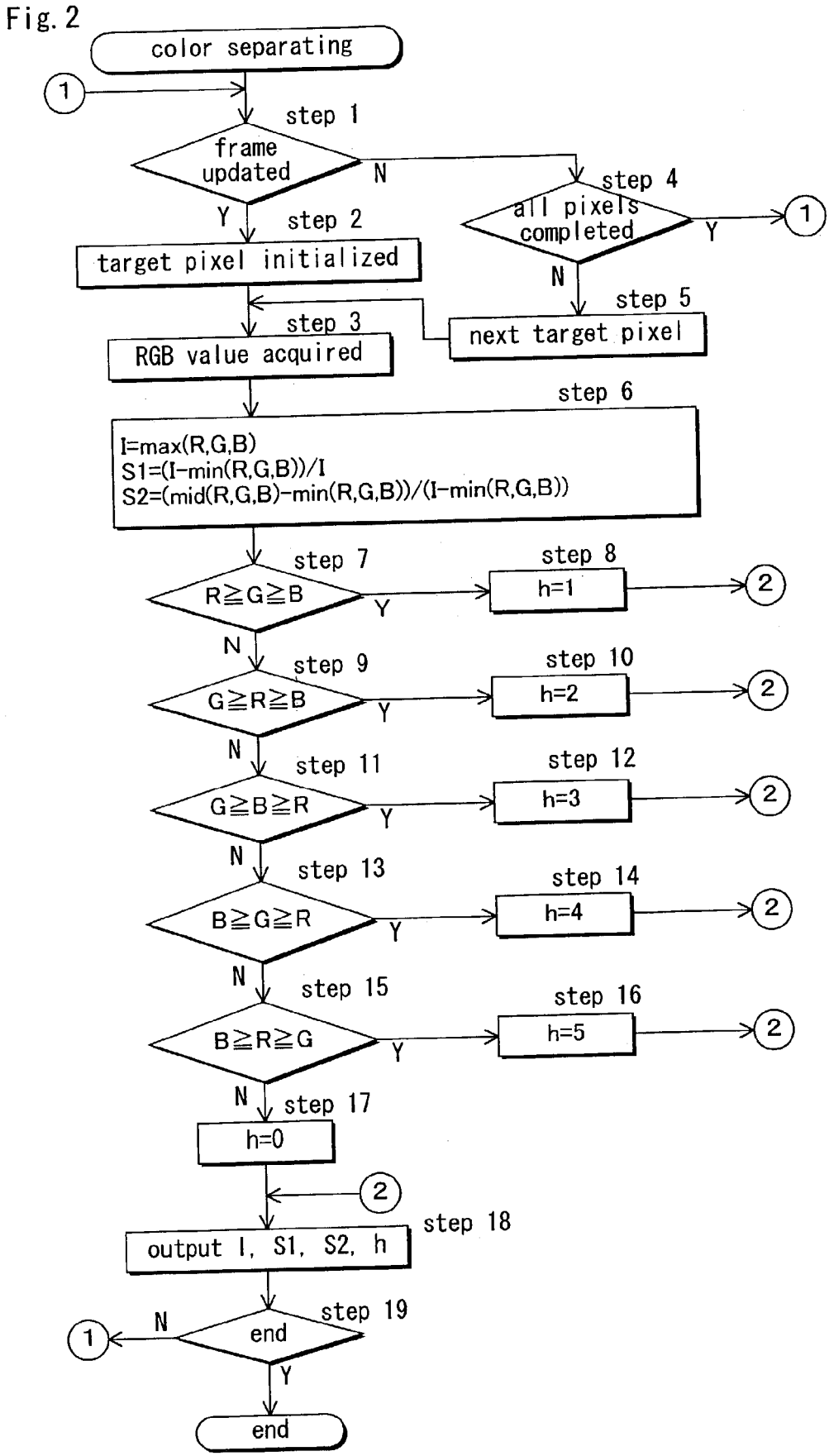
FIG. 2 is a flowchart illustrating how color separation is made.

In view of the above description, components as illustrated in FIG. 1 are now described. In FIG. 1, a color-separating unit 1 in receipt of display data (RGB values) provides processing as illustrated in FIG. 2, thereby separating RGB values into luminance "I," saturation "S1", and hue "S2". The separated elements leave the color-separating unit 1.

The color-separating unit 1 determines relevant parameter "h". The relevant parameter "h" refers to a magnitude relationship of the RGB values. The determined relevant parameter "h" leaves the color-separating unit 1.

At step 1 in FIG. 2, the color-separating unit 1 checks to see whether a frame has been renewed. When the frame has been renewed, then at step 2, a pixel on a display screen (e.g., a pixel at an upper-left corner of the display screen) is initialized as a target pixel. When the frame has been non-renewed, then at step 5, another pixel is initialized as a target pixel when it is found at step 4 that several pixels on the display screen remain to be processed.

At step 3, the color-separating unit 1 obtains the RGB values for each of the target pixels. At step 6, the color-separating unit 1 determines luminance "I", saturation "S1", and hue "S2" from the obtained RGB values in accordance with the following formulas:

$$I=\max(R, G, B) \quad (1)$$

$$S1=(I-\min(R, G, B)) \text{ divided by } I \quad (2)$$

$$S2=(\text{mid}(R, G, B)-\min(R, G, B) \text{ divided by } (I-\min(R, G, B)) \quad (3)$$

where "max (R, G, B)" refers to a maximum value in the RGB values; "min (R, G, B)" refers to a minimum value in the RGB values; and "mid (R, G, B)" refers to an intermediate value between the maximum and minimum values.

As evidenced by formula 1, the term "luminance I" as set forth herein refers to a maximum value of the RGB values, not a commonly used Y-value in YUV signals. The definition that luminance "I" is the maximum value of the RGB values provides enhanced visual quality of a pure color.

At steps 7 to 16, the color-separating unit 1 checks a magnitude relationship of the RGB values to determine relevant parameter "h".

More specifically, at step 8, parameter "h" is equal to 1 for R≧G≧B at step 7. At step 10, parameter "h" is equal to 2 for G≧R≧B at step 9.

At step 12, parameter "h" is equal to 3 for G≧B≧R at step 11. At step 14, parameter "h" is equal to 4 for B≧G≧R at step 13. At step 16, parameter "h" is equal to 5 for B≧R≧G at step 15.

At step 17, parameter "h" is set to be zero when all of the above magnitude relationships of the RGB values are non-applicable, which does not normally occur.

At step 18, the determined luminance "I", saturation "S1", hue "S2", and relevant parameter "h" leave the color-separating unit 1 in such a manner as illustrated in FIG. 1. The processing according to steps 1 to 18 is repeated until the whole processing is completed at step 19.

In FIG. 1, a luminance-transforming unit 2 provides the luminance transformation of luminance "I" from the color-separating unit 1 in accordance with a luminance-transforming parameter that is sent from a parameter-calculating unit 10, thereby providing transformed luminance "I#". The luminance-transforming unit 2 feeds the transformed luminance "I#" to a luminance-normalizing unit 3.

Details of the luminance-transforming parameter and details of the luminance transformation using the luminance-transforming unit 2 are discussed later. The luminance transformation is obeyed in accordance with a relationship as illustrated FIG. 6. FIG. 6 is formed by a horizontal axis showing luminance "I" taken out of the display data, and a vertical axis showing the transformed luminance "I#". FIG. 6 illustrates three different slope averages: slope average "r1" for a range of 0≦I<Iave; slope average "r2" for a range of Iave≦I<I1max; and slope average "r3" for a range of I≧I1max. These slope averages establish a magnitude relationship of r1≧r2>r3.

The luminance-normalizing unit 3 in receipt of the transformed luminance "I#" from the luminance-transforming unit 2 normalizes the transformed luminance "I#" in such a manner that the transformed luminance "I#" has a maximum value of 100% (e.g., 255 for 8-bit accuracy), thereby providing normalized luminance "Ib". The luminance-normalizing unit 3 feeds the normalized luminance "Ib" into a color-combining unit 5.

At this time, the luminance-normalizing unit 3 uses a normalizing parameter [Ip] (see FIG. 9) from a light-emitting compensation table 11. The light-emitting compensation table 11 is discussed later. The use of the light-emitting compensation table 11 ensures a correlation between adjustment of luminance of a backlight 14 and adjustment of luminance of a transmissive LCD 13.

A saturation-transforming unit 4 in receipt of saturation S1 from the color-separating unit 1 transforms saturation in accordance with a saturation-transforming parameter that is sent from the parameter-calculating unit 10, thereby providing transformed saturation "S1#". The saturation-transforming unit 4 feeds the transformed saturation "S1#" into the color-combining unit 5.

Figure 7:
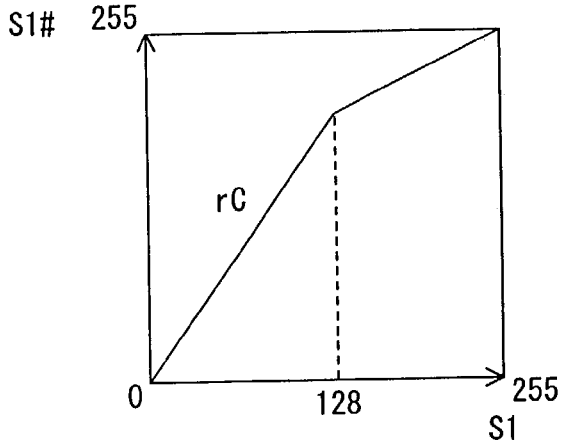
FIG. 7 is a graph illustrating saturation-transforming characteristics.

The saturation is transformed in accordance with characteristics of FIG. 7. Saturation-transforming parameter "rC" is a slope of a region (0≦rc<128 for 8t-bit accuracy) having small saturation.

As described later, the parameter-calculating unit 10 sets saturation-transforming parameter "rC" in accordance with a graph of FIG. 8. Parameter "rC" is greater than one. Parameter "rC" greater than one enhances the saturation over linear characteristics in the region having small saturation, thereby providing improved visual quality.

Figure 3:
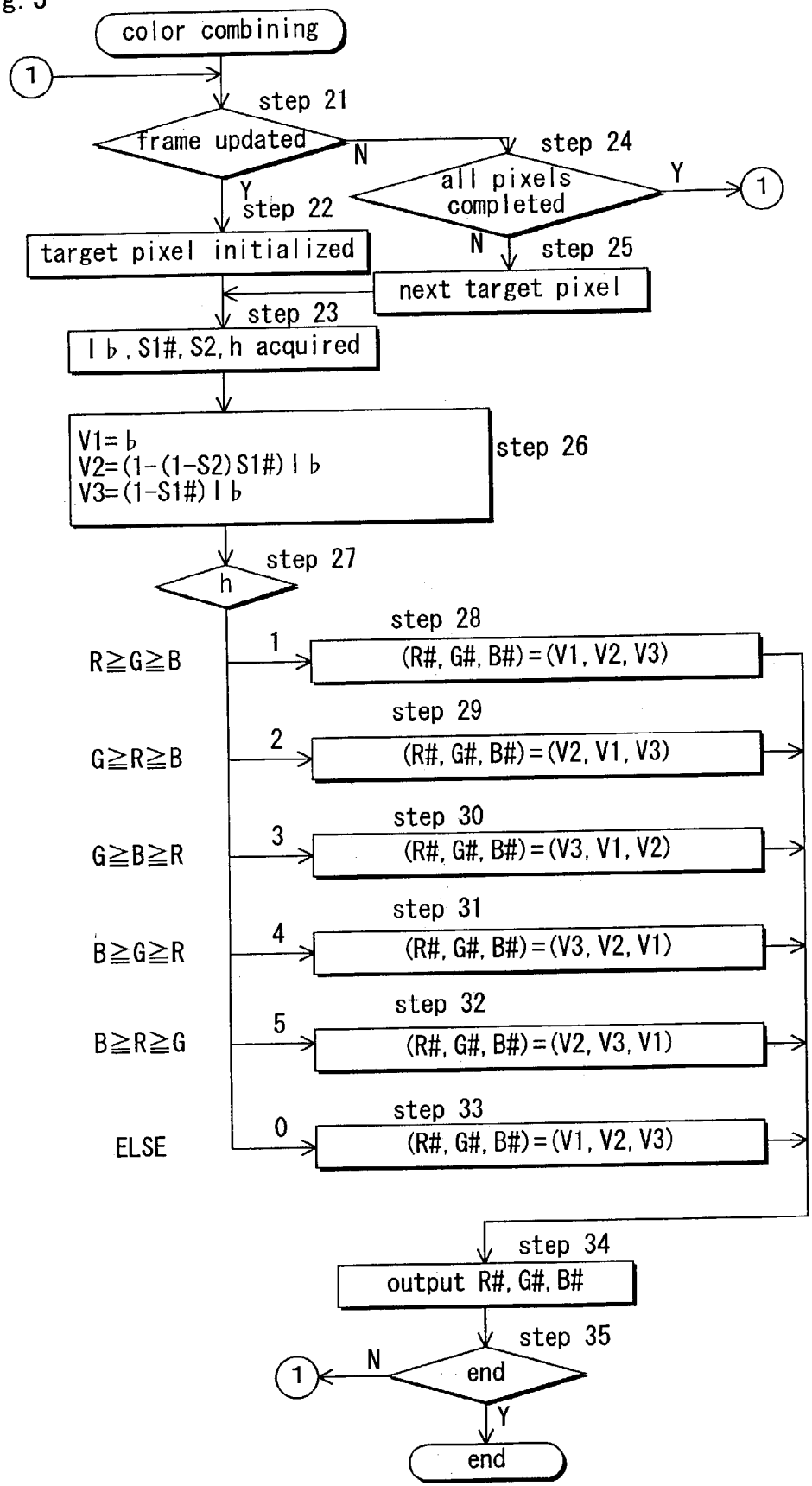
FIG. 3 is a flowchart illustrating how color synthesis is made.

In FIG. 1, the color-combining unit 5 in receipt of the normalized luminance "Ib", the transformed saturation "S1#", the hue "S2", and the relevant parameter "h" practices processing as illustrated in FIG. 3, thereby feeding adjusted RGB values (R#, G#, and B#) into the transmissive LCD 13.

More specifically, at step 21 of FIG. 3, the luminance-transforming unit 2 checks to see whether a frame has been renewed. When the frame has been renewed, then at step 22, a pixel on the display screen (e.g., a pixel at an upper-left corner of the display screen) is initialized as a target pixel.

When the frame has not been renewed, then at step 25, another pixel is renewed as a target pixel when it is found at step 24 that several pixels on the display screen remain to be processed.

At step 23, the color-combing unit 5 obtains the normalized luminance "Ib", the transformed saturation "S1#", the hue "S2", and the relevant parameter "h" for each of the target pixels. At step 26, the color-combining unit 5 determines three values V1, V2, and V3 that follow:

$$V1=Ib \tag{4}$$

$$V2=(1-(1-S2)S1\#)Ib \tag{5}$$

$$V3=(1-S1\#)Ib \tag{6}$$

At steps 27 to 33, the color-combining unit 5 allocates the determined V1, V2, and V3 according to formulas 4 to 6 to the adjusted RGB values (R#, G#, and B#) in accordance with relevant parameter "h" i.e., in accordance with a magnitude relationship of the pre-adjusted RGB values.

It is sufficient that the color-combining unit 5 allows the adjusted RGB values (R#, G#, and B#) to be properly connected to the pre-adjusted RGB values (pre-adjusted RGB values for each of the target pixels) of display data. This means that relevant parameter "h" may not always be used unlike the present embodiment. For example, the pre-adjusted RGB values may be entered from the color-separating unit 1 directly into the color-combing unit 5.

At any rate, the color-combining unit 5 practices the processing according to steps 21 to 33, thereby obtaining the adjusted RGB values (R#, G#, and B#) for each of the target pixels. At step 34, the color-combining unit 5 feeds the adjusted RGB values (R#, G#, and B#) into the transmissive LCD 13.

At step 35, the color-combining unit 5 repeats the processing according to steps 21 to 34 until being instructed to stop.

Figure 4:
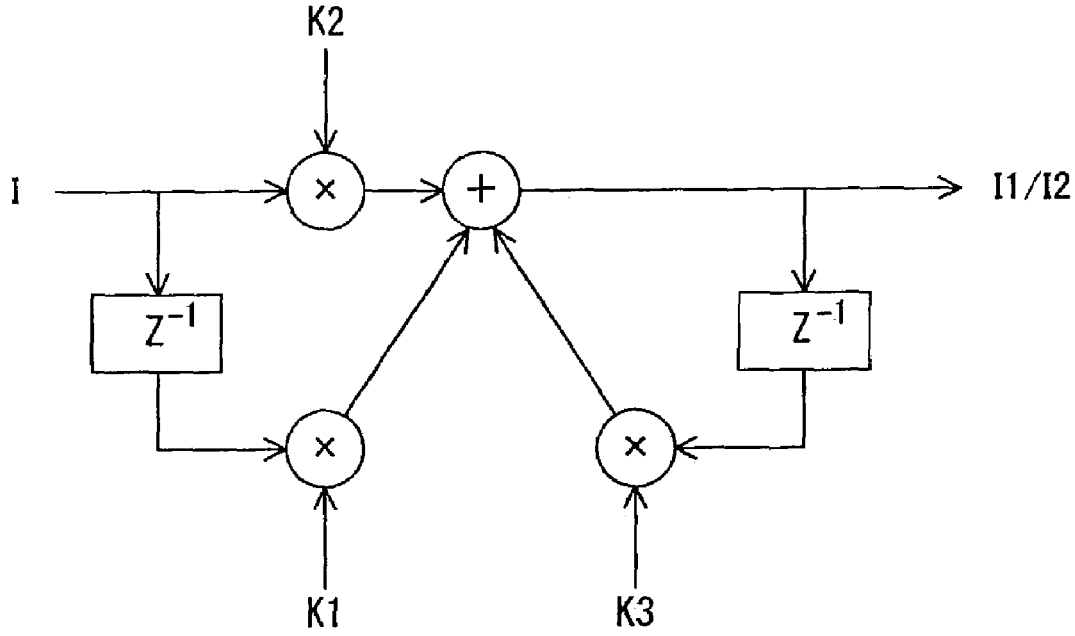
FIG. 4 is an illustration showing how filters are constructed.

Components at a lower-left position of FIG. 1 are now described. The color-separating unit 1 feeds luminance "I" into first and second low pass filters 6 and 7. According to the present embodiment, the first and second low pass filters 6 and 7 are "IIR" filters as illustrated in FIG. 4.

First and second filter parameters are provided to the first and second low pass filters 6 and 7, respectively. More specifically, the first and second filter parameters are coefficients (k1, k2, and k3) to be provided to three multipliers as illustrated in FIG. 4.

A proper selection of the coefficients permits the first low pass filter 6 to be functioned as a "coarse" filter, while allowing the second low pass filter 7 to be operated as a "fine" filter. The "coarse" filter feeds luminance I1 in a macro area into a maximum value-calculating unit 8. The "fine" filter feeds luminance I2 in a micro area into the maximum value-calculating unit 8.

The maximum value-calculating unit 8 in receipt of, from the first and second low pass filters 6 and 7, luminance "I1" (in the macro area) and luminance "I2" (in the micro area) for one frame or for one display screen feeds maximum values ("I1max" and "I2max") of the luminance "I1" and "I2" on the display screen into the parameter-calculating unit 10 each time when the frame is renewed.

The maximum values "I1max" and "I2max" are amounts that characterize a frame image.

The color-separating unit 1 feeds luminance "I" and saturation "S1" for one frame or for one display screen into the average value-calculating unit 9. The average value-calculating unit 9 determines a luminance average value "Iave" and a saturation average value "Slave" on the display screen each time when the frame is renewed. The average value-calculating unit 9 feeds the determined average values "Iave" and "Slave" into the parameter-calculating unit 10.

The average values "Iave" and "Slave" are amounts that characterize the flame image.

The amounts that characterize the frame image are fed into the parameter-calculating unit 10. Many variations and modifications may be made in a range in which objects of the present invention are attained. For example, a minimum luminance value, minimum saturation value, color distribution, and luminance at an important area (e.g., a near-central area), not the entire frame may be entered into the parameter-calculating unit 10. Alternatively, the RGB values of display data may be entered directly into the parameter-calculating unit 10 in which required values are determined.

According to the present embodiment, the above-described two maximum values ("I1max" and I2max") and two different average values ("Iave" and "Slave") from the maximum value-calculating unit 8 and the average value-calculating unit 9, respectively, are fed into the parameter-calculating unit 10 each time when the frame is renewed.

Figure 8:
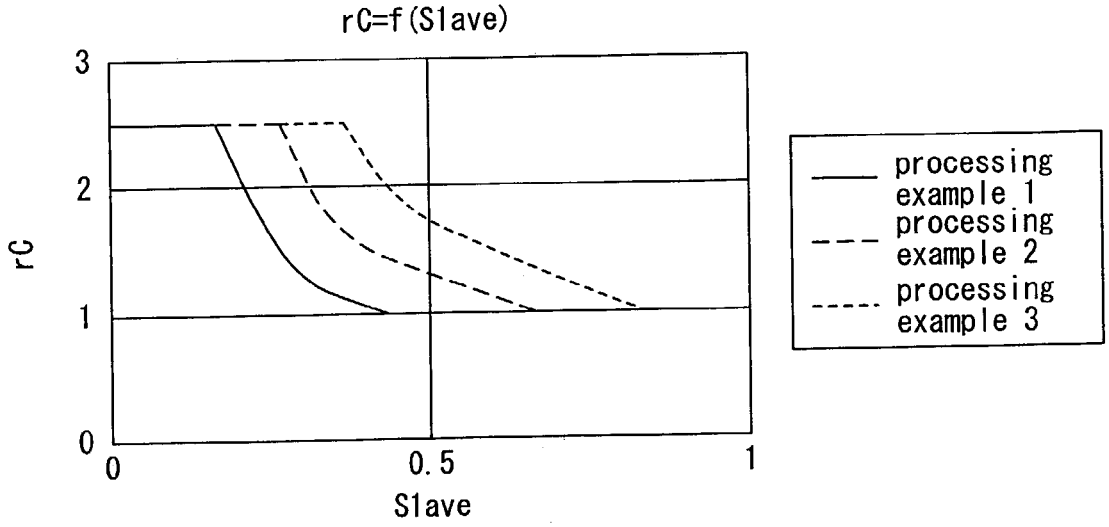
FIG. 8 is a descriptive illustration showing how "rC" parameter is determined.

Slopes "r1", "r2", "r3" as well as a parameter that determines "rC" value as illustrated in FIG. 8 are entered as calculation conditions into the parameter-calculating unit 10 during image quality adjustment.

Figure 5:
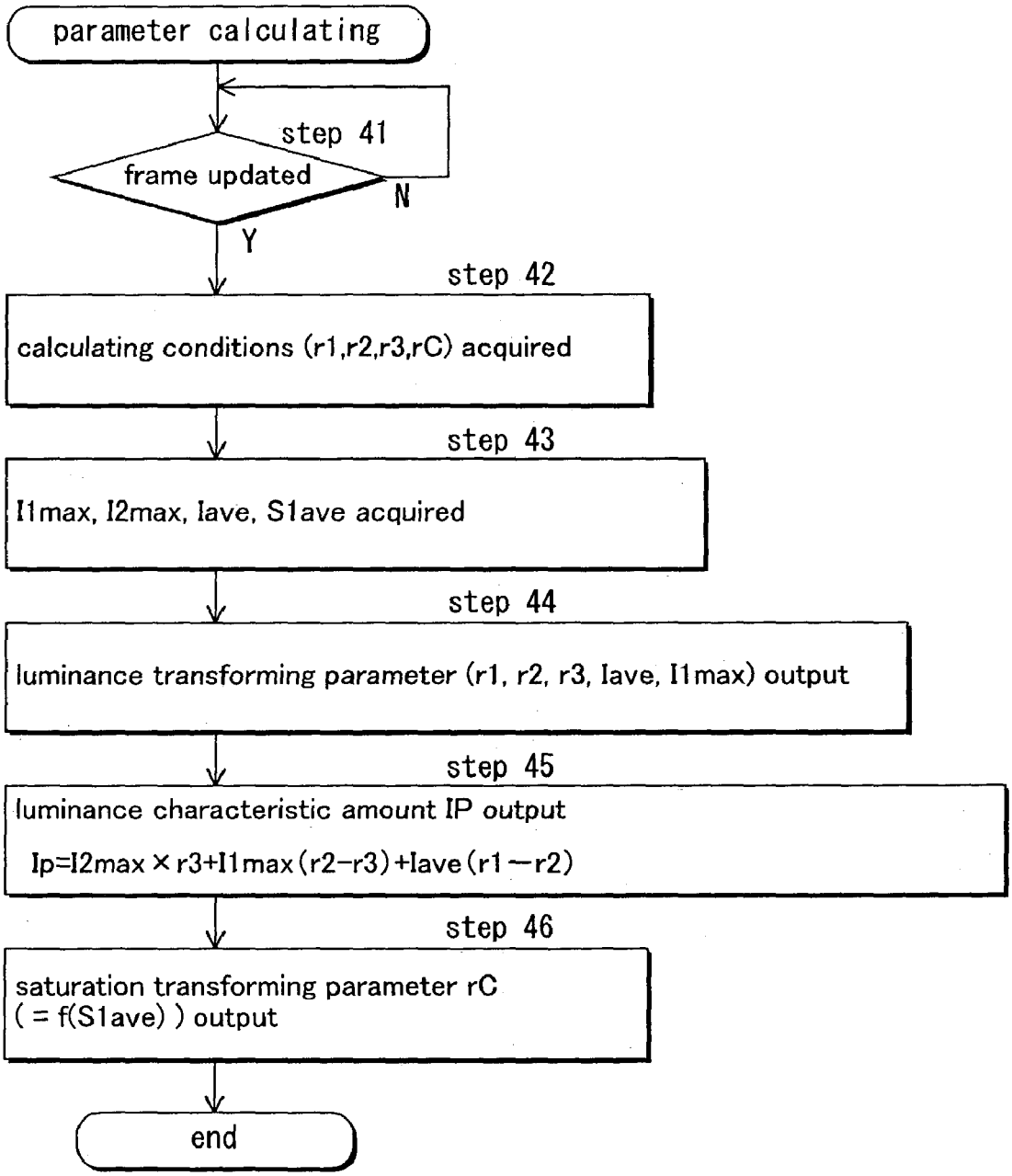
FIG. 5 is a flowchart illustrating how parameters are calculated.

The parameter-calculating unit 10 determines luminance characteristic amount "Ip", luminance-transforming parameters (r1, r2, r3, lave, I1max) and saturation-transforming parameter (rC) in accordance with a flowchart of FIG. 5, and then feeds them into the light-emitting compensation table 11, the luminance-transforming unit 2, and the saturation-transforming unit 4, respectively.

More specifically, at step 41 of FIG. 5, the parameter-calculating unit 10 waits for frame renewal. When a frame is renewed, then at step 42, the parameter-calculating unit 10 obtains the calculation conditions.

The calculation conditions are now described. As illustrated in FIG. 6, slopes "r1", "r2", "r3" among the calculation conditions are amounts that determine characteristics of luminance transformation (I→I#). In other words, the luminance transformation is obedient to a line plot having two bends.

A discussion is started with a starting point ((I, I#)-(0, 0)). An area in a range of I<Iave is dark, and is difficult to obtain a perceptible contrast. A surrounding area of "Iave" is expected to have the highest luminance contribution. As a result, the surrounding area of "Iave" is of great influence on visual quality.

In the dark area of the range of I<Iave, retention or improvement of the perceptible contrast is valued over a saving in power consumption. The range of I<Iave has the greatest slope average "r1" to provide improved visual quality.

An area in a range of Iave≦I<I1max is bright, and is easy to obtain the perceptible contrast. Accordingly, the area in the range of Iave≦I<I1max puts a high priority on a saving in power consumption. The area in the range of Iave≦I<I1max has an intermediate degree of slope average "r2". This means that slope average "r2" is smaller than slope average "r1", but is greater than slope average "r3".

An area in a range of I≧I1max is very bright, and is almost impossible for human eyes to perceive a contrast, even when the contrast is reduced. Accordingly, the very bright area in the range of I≧I1max gives utmost priority to a saving in power consumption to provide a minimum degree of slope average "r3".

As a result, "I#max" is suppressed to a degree considerably smaller than 100% (255 for 8-bit accuracy).

As a special alternative, slope averages of "r1"="r2" and "r3" zero are acceptable. In this case, a graph has a bend, but such a graph may be sufficient in view of practical use. Accordingly, this alternative is encompassed by the present invention.

The linearly drawn area in the range of I≧Iave as illustrated in FIG. 6 may be replaced by a curvilinearly drawn area in the same range.

The parameter-calculating unit 10 determines "rC" parameter in accordance with a graph of FIG. 8 using average value "Slave". FIG. 8 illustrates processing examples 1, 2, and 3 because characteristics to be selected differ from each other, depending upon color purity (color intensity) of the transmissive LCD 13.

Any one of the processing examples 1, 2, and 3 is selected, which is suited for the transmissive LCD 13. Such a selection makes it feasible to make saturation adjustment in which the color purity inherent to the transmissive LCD 13 is reflected. As a result, further improved visual quality is provided. A description on the calculation conditions is now completed.

After obtaining calculation condition values at step 42 of FIG. 5, the parameter-calculating unit 10 obtains, at step 43, the following: two maximum values, "I1max" and "I2max", from the maximum value-calculating unit 8; and two average values, "Iave" and "Slave", from the average value-calculating unit 9.

At step 44, the parameter-calculating unit 10 feeds slopes (r1, r2, r3), average value "Iave", and maximum value "I1max", as luminance-transforming parameters, into the luminance-transforming unit 2.

At step 45, the parameter-calculating unit 10 determines luminance characteristic amount "Ip" in accordance with the following formula:

$$Ip=I12\max\times r3+I1\max(r2-r3)+Iave(r1-r2) \quad (7)$$

The parameter-calculating unit 10 feeds the determined luminance characteristic amount "Ip" into the light-emitting compensation table 11.

At step 46, the parameter-calculating unit 10 determines a value of "rC" from the graph of FIG. 8 using "Slave" and "rC" parameter, and then feeds the determined value "rC" as a saturation-transforming parameter into the saturation-transforming unit 4.

As illustrated in FIG. 9, the light-emitting compensation table 11 of FIG. 1 is a one-dimensional table. The table 11 contains luminance characteristic amounts "Ip", normalizing parameters [Ip], and light-emitting luminance [Ip#]. In the table 11, these three different factors are related to each other. The normalizing parameter [Ip] is fed to the luminance-normalizing unit 3. The light-emitting luminance [Ip#] is sent to a driving circuit 12.

The light-emitting luminance [Ip#] has values obedient to contra-characteristics. The contra-characteristics counteract γ-characteristics of the transmissive LCD 13 as a display device.

This feature virtually removes the inherent characteristics of the transmissive LCD 13, thereby providing improved visual quality.

As described above, the luminance-transforming unit 2 provides luminance transformation in accordance with the luminance-transforming parameter calculated by the parameter-calculating unit 10. The light-emitting compensation table 11 determines light-emitting luminance [Ip#] in accordance with the luminance characteristic amount calculated by the parameter-calculating unit 10. The driving circuit 12 drives the backlight 14 to illuminate the backlight 14 at a desired degree of light-emitting luminance.

This feature ensures a correlation between adjustment of luminance of the transmissive LCD 13 as a display device and adjustment of luminance of the backlight 14 as a light source.

As described above, the present invention provides a further reduction in power consumption, while maintaining a perceptible contrast.

The present invention provides improved visual quality of a pure color, while allowing a light source to consume further less power.

The present invention provides accurate adjustment of a display device and accurate adjustment of the light source, while allowing the light source to consume further less power.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An image display method comprising:

irradiating light from a light source to a light-receiving display device to display an image;

providing a correlation between adjustment of luminance of the display device and adjustment of luminance of the light source in accordance with entered display data;

determining a characteristic-determining amount from the display data;

providing luminance transformation of luminance taken out of the display data, thereby providing a luminance-transformed luminance; and adjusting the luminance of the display device in accordance with the luminance-transformed luminance, wherein the luminance transformation has transformation characteristics in which different slope averages in the vicinity of the characteristic-determining amount are exhibited in an area defined by a horizontal axis showing luminance "I" taken out of the display data and a vertical axis showing luminance-transformed luminance "I#", and wherein in the transformation characteristics, a region having luminance smaller than the characteristic-determining amount is set to have an average slope greater than an average slope of a region having luminance greater than the characteristic-determining amount.

2. An image display method as defined in claim 1, wherein in the transformation characteristics, a region closer in distance to a coordinate origin is set to have an average slope greater than an average slope of another region.

3. An image display method as defined in claim 1, wherein in the transformation characteristics, a region closer in distance to a full scale is set to have an average slope smaller than an average slope of another region.

4. An image display method as defined in claim 1, wherein the characteristic-determining amount includes two different characteristic-determining amounts.

5. An image display method as defined in claim 1, wherein the characteristic-determining amount includes three different characteristic-determining amounts.

6. An image display method as defined in claim 1, wherein the characteristic-determining amount includes a luminance representative value in an entire display screen.

7. An image display method as defined in claim 6, wherein the luminance representative value includes one of or both a luminance average value and a maximum frequent value in a luminance histogram.

8. An image display method as defined in claim 1, wherein one of or both a straight line and a curved line form the transformation characteristics.

9. An image display method as defined in claim 1, wherein a maximum value of RGB values in an entire image is employed as luminance for use in the adjustment of the luminance of the display device and the adjustment of the luminance of the light source.

10. An image display method as defined in claim 9, wherein saturation is adjusted in union with one or both of the adjustment of the luminance of the display device and the adjustment of the luminance of the light source.

11. An image display method as defined in claim 10, wherein the saturation is adjusted to provide increased saturation in a region in which a perceptible contrast is reduced.

12. An image display method as defined in claim 1, wherein saturation is adjusted in union with one or both of the adjustment of the luminance of the display device and the adjustment of the luminance of the light source.

13. An image display method as defined in claim 12, wherein the saturation is adjusted to provide increased saturation in a region in which a perceptible contrast is reduced.

14. An image display method as defined in claim 1, wherein a maximum value of RGB values in an entire image is employed as luminance for use in the adjustment of the luminance of the display device and the adjustment of the luminance of the light source.

15. An image display method as defined in claim 1, wherein saturation is adjusted in union with one or both of the adjustment of the luminance of the display device and the adjustment of the luminance of the light source.

16. An image display method as defined in claim 15, wherein the saturation is adjusted to provide increased saturation in a region in which a perceptible contrast is reduced.

17. An image display method comprising:

irradiating light from a light source to a light-receiving display device to display an image;

providing a correlation between adjustment of luminance of the display device and adjustment of luminance of the light source in accordance with entered display data;

determining, from the display data, a luminance representative value "Ir" in an entire display screen and a luminance maximum value "I1max" in a macro area;

providing luminance transformation of luminance taken out of the display data, thereby providing a luminance-transformed luminance; and adjusting the luminance of the display device in accordance with the luminance-transformed luminance, wherein the luminance transformation has transformation characteristics in which slope average "r1" in a range of $0 \leqq I < Ir$, slope average "r2" in a range of $Ir \leqq I < I1max$, and slope average "r3" in a range of $I \geqq I1max$ establish a relationship of $r1 \geqq r2 > r3$ in an area defined by a horizontal axis showing luminance "I" taken out of the display data and a vertical axis showing luminance-transformed luminance "I#".

18. An image display method as defined in claim 17, wherein slope averages "r1", "r2", and "r3" are varied according to a state that includes display content, display time, and surrounding circumstances.

19. An image display method as defined in claim 17, wherein saturation is adjusted in union with one or both of the adjustment of the luminance of the display device and the adjustment of the luminance of the light source.

20. An image display method as defined in claim 19, wherein the saturation is adjusted to provide increased saturation in a region in which a perceptible contrast is reduced.

21. An image display method as defined in claim 17, wherein a luminance maximum value "I2max" in a micro area is determined from the display data, and wherein a luminance characteristic amount "Ip" is determined in accordance with "I1max", "I2max", "Ir", "r1", "r2", "r3", and the light source has luminance adjusted in accordance with the determined luminance characteristic amount "Ip".

22. An image display method as defined in claim 17, wherein the luminance representative value "Ir" includes one of or both a luminance average value "Iave" and a maximum frequent value in a luminance histogram.

23. An image display apparatus comprising:

a light-receiving display device;

a light source operable to irradiate light to said light-receiving display device;

said image display apparatus operable to provide a correlation between adjustment of luminance of said light-receiving display device and adjustment of luminance of said light source in accordance with entered display data;

a characteristic-determining amount-calculating unit operable to determine a characteristic-determining amount from the display data; and a luminance-transforming unit operable to provide, with reference to transformation characteristics, luminance transformation of luminance taken out of the display data, wherein the transformation characteristics are such that different slope averages in the vicinity of the characteristic-determining amount are exhibited in an area defined by a horizontal axis showing luminance "I" taken out of the display data and a vertical axis showing luminance-transformed luminance "I#", and wherein in the transformation characteristics, a region having luminance smaller than the characteristic-determining amount is set to have an average slope greater than an average slope of a region having luminance greater than the characteristic-determining amount.

24. An image display apparatus as defined in claim 23, wherein in the transformation characteristics, a region closer in distance to a coordinate origin is set to have an average slope greater than an average slope of another region.

25. An image display apparatus as defined in claim 23, wherein in the transformation characteristics, a region closer in distance to a full scale is set to have an average slope smaller than an average slope of another region.

26. An image display apparatus as defined in claim 23, wherein the characteristic-determining amount includes two different characteristic-determining amounts.

27. An image display apparatus as defined in claim 23, wherein the characteristic-determining amount includes three different characteristic-determining amounts.

28. An image display apparatus as defined in claim 23, wherein the characteristic-determining amount includes a luminance representative value in an entire display screen.

29. An image display apparatus as defined in claim 28, wherein the luminance representative value includes one of or both a luminance average value and a maximum frequent value in a luminance histogram.

30. An image display apparatus as defined in claim 23, wherein one of or both a straight line and a curved line form(s) the transformation characteristics.

31. An image display apparatus as defined in claim 23, wherein a maximum value of RGB values in an entire image is employed as luminance for use in the adjustment of the luminance of said light-receiving display device and the adjustment of the luminance of said light source.

32. An image display apparatus comprising:

a light-receiving display device;

a light source operable to irradiate light to said light-receiving display device;

said image display apparatus operable to provide a correlation between adjustment of luminance of said light-receiving display device and adjustment of luminance of said light source in accordance with entered display data;

a representative-calculating unit operable to determine, with reference to the display data, a luminance representative value "Ir" in an entire display screen;

a maximum value-calculating unit operable to determine, with reference to the display data, a luminance maximum value "I1max" in a macro area; and a luminance-transforming unit operable to provide luminance transformation of luminance taken out of the display data, wherein said luminance-transforming unit provides the luminance transformation such that slope average "r1" in a range of $0 \leqq I < Ir$, slope average "r2" in a range of $Ir \leqq I < I1max$, and slope average "r3" in a range of $I \geqq I1max$ establish a relationship of $r1 \geqq r2 > r3$ in an area defined by a horizontal axis showing luminance "I" taken out of the display data and a vertical axis showing luminance-transformed luminance "I#".

33. An image display apparatus as defined in claim 32, wherein slope averages "r1", "r2", and "r3" are varied according to a state that includes display content, display time, and surrounding circumstances.

34. An image display apparatus as defined in claim 32, further comprising:

a saturation-transforming unit operable to adjust saturation in union with one or both of the adjustment of the luminance of said light-receiving display device and the adjustment of the luminance of said light source.

35. An image display apparatus as defined in claim 34, wherein the saturation is adjusted to provide increased saturation in a region in which a perceptible contrast is reduced.

36. An image display apparatus as defined in claim 32, wherein said maximum value-determining unit is operable to determine, from the display data, a luminance maximum value "I2max" in a micro area, and wherein a luminance characteristic amount "Ip" is determined in accordance with "I1max", "I2max", "Ir", "r1", "r2", "r3", and said light source has luminance adjusted in accordance with the determined luminance characteristic amount "Ip".

37. An image display apparatus as defined in claim 32, wherein the luminance representative value "Ir" includes one of or both a luminance average value "Iave" and a maximum frequent value in a luminance histogram.

* * * * *